US008733456B2

(12) United States Patent
Lehr et al.

(10) Patent No.: US 8,733,456 B2
(45) Date of Patent: May 27, 2014

(54) APPARATUS AND METHODS FOR MULTI-LAYER WELLBORE CONSTRUCTION

(75) Inventors: Joerg Lehr, Lower Saxony (DE); Ines Gruetzmann, Lehrte-Arpke (DE); Detlev Benedict, Nienhagen (DE); Wiebke Schoenebeck, Celle (DE); Keven O'Connor, Houston, TX (US); Matthias R. Moeller, Braunschweig (DE)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 12/948,046

(22) Filed: Nov. 17, 2010

(65) Prior Publication Data

US 2011/0114336 A1 May 19, 2011

Related U.S. Application Data

(60) Provisional application No. 61/262,068, filed on Nov. 17, 2009.

(51) Int. Cl.
*E21B 17/02* (2006.01)

(52) U.S. Cl.
USPC ..... 166/382; 166/207; 166/208; 166/242.6; 166/384

(58) Field of Classification Search
USPC ..... 166/277, 380, 382, 384, 207, 208, 166/241.1, 241.6
See application file for complete search history.

(56) References Cited

U.S. PATENT DOCUMENTS

| | | | | |
|---|---|---|---|---|
| 6,585,053 | B2 * | 7/2003 | Coon | 166/387 |
| 6,702,029 | B2 * | 3/2004 | Metcalfe et al. | 166/378 |
| 6,942,029 | B2 * | 9/2005 | Simpson | 166/207 |
| 7,066,259 | B2 * | 6/2006 | Duggan et al. | 166/277 |
| 7,073,599 | B2 | 7/2006 | Smith | |
| 7,077,210 | B2 * | 7/2006 | MacKay et al. | 166/380 |
| 7,156,179 | B2 * | 1/2007 | Harrall et al. | 166/380 |
| 7,178,601 | B2 * | 2/2007 | Burge | 166/380 |
| 7,195,064 | B2 * | 3/2007 | Cook et al. | 166/277 |
| 7,367,391 | B1 * | 5/2008 | Stuart et al. | 166/208 |
| 7,410,001 | B2 * | 8/2008 | Harrall et al. | 166/380 |
| 7,546,886 | B2 * | 6/2009 | Benzie et al. | 175/57 |
| 7,617,868 | B2 * | 11/2009 | Stuart et al. | 166/208 |

(Continued)

FOREIGN PATENT DOCUMENTS

RU 2161239 12/2000

OTHER PUBLICATIONS

International Search Report mailed Jun. 9, 2011, International Application No. PCT/US2010/057040; references cited in PCT are listed above.

(Continued)

*Primary Examiner* — Jennifer H Gay
(74) *Attorney, Agent, or Firm* — Cantor Colburn LLP

(57) ABSTRACT

A monobore wellbore apparatus and method of construction. The apparatus includes a series of overlapping expandable liner sections. The overlapping liner sections may be expanded and pressed to provide no gaps along the length of the liner system. The liner sections may include centralizers and/or circumferential seals that provide sealing functions and spaces between the overlapping liner sections. The liner sections may be lined with a suitable sealing material, including an epoxy or may be filled with cement or another desired materials.

21 Claims, 7 Drawing Sheets

(56) References Cited

U.S. PATENT DOCUMENTS

| | | | | |
|---|---|---|---|---|
| 7,798,223 | B2 * | 9/2010 | Duggan et al. | 166/277 |
| 7,967,077 | B2 * | 6/2011 | Ezell et al. | 166/387 |
| 2002/0166668 | A1 * | 11/2002 | Metcalfe et al. | 166/378 |
| 2003/0047321 | A1 * | 3/2003 | Coon | 166/380 |
| 2004/0007364 | A1 | 1/2004 | Simpson | |
| 2004/0055754 | A1 * | 3/2004 | MacKay et al. | 166/380 |
| 2004/0221996 | A1 | 11/2004 | Burge | |
| 2004/0256112 | A1 * | 12/2004 | Harrall et al. | 166/380 |
| 2004/0262014 | A1 * | 12/2004 | Cook et al. | 166/382 |
| 2006/0000617 | A1 * | 1/2006 | Harrall et al. | 166/380 |
| 2006/0054330 | A1 | 3/2006 | Ring et al. | |
| 2007/0034408 | A1 * | 2/2007 | Benzie et al. | 175/57 |
| 2008/0210440 | A1 * | 9/2008 | Stuart et al. | 166/382 |
| 2009/0090516 | A1 | 4/2009 | DeLucia et al. | |
| 2009/0205840 | A1 * | 8/2009 | O'Connor et al. | 166/382 |
| 2011/0114336 | A1 * | 5/2011 | Lehr et al. | 166/380 |
| 2012/0085549 | A1 * | 4/2012 | O'Connor et al. | 166/380 |

OTHER PUBLICATIONS

Written Opinion of the International Searching Authority mailed Jun. 9, 2011; International Application No. PCT/US2010/057040.

* cited by examiner

APPARATUS AND METHODS FOR MULTI-LAYER WELLBORE CONSTRUCTION

CROSS REFERENCES TO RELATED APPLICATIONS

This application claims priority from the U.S. Provisional Patent Application having the Ser. No. 61/262,068 filed Nov. 17, 2009.

BACKGROUND

1. Field of the Disclosure

The disclosure relates generally to apparatus and methods for wellbore completion.

2. Description of the Related Art

Hydrocarbons, such as oil and gas, as well as geothermal resources are recovered from a subterranean formation using a wellbore drilled into the formation. Such wellbores are typically completed by placing a casing along the wellbore length, cementing the annulus between the casing and the wellbore and perforating the casing adjacent each production zone. A wellbore casing is often made by joining relatively short pipe sections (for example 30 m long) via threaded connections at the pipe ends. Such conventional casing techniques utilize tubular strings of decreasing diameters and include multiple threaded connections. Monobore wellbore construction utilizing a solid casing design has limitations in terms of achievable collapse resistance of an expanded tubular. Expansion of liner elements connected with threads run a high risk with respect to the achievable long term reliability. The cost of building deep and extended reach wells is very high. Therefore, it is desirable to provide alternative methods of building such wellbores.

Thus, there is a need for improved apparatus and methods for building wellbores for transporting fluid to or from downhole locations without exposing the fluid to the wellbore locations between the surface and the downhole locations.

SUMMARY

In aspects, the present disclosure provides wellbore construction apparatus and methods. A wellbore made according to one embodiment may include a series of overlapping expandable liner sections. In one aspect, the overlapping liner sections may be expanded and pressed to provide no gaps along the length of the liner system. In another aspect, the liner sections may include centralizers and/or circumferential seals that provide sealing functions and spaces between the overlapping liner sections. The liner sections may be lined with a suitable sealing material, including an epoxy, cement or another desired material.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended herein.

BRIEF DESCRIPTION OF THE DRAWINGS

The advantages and further aspects of the disclosure will be appreciated by those of ordinary skill in the art as the same becomes better understood by reference to the following detailed description in conjunction with the accompanying drawings in which like reference characters generally designate like or similar elements in the several figures of the drawing and wherein.

DETAILED DESCRIPTION

Figure 1A:
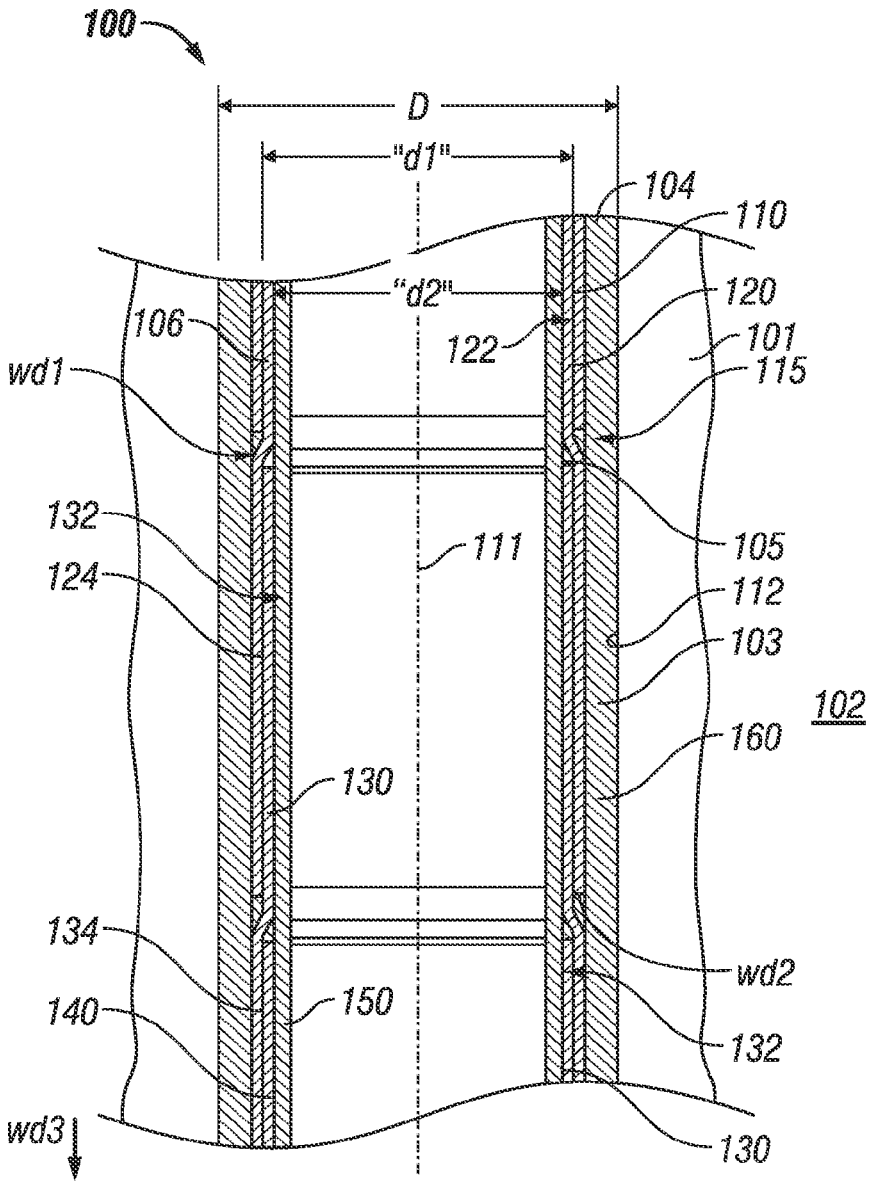
FIG. 1A shows a sectional view of a segment of a monobore wellbore cased according to one embodiment of the disclosure.

The present disclosure relates to monobore wellbores using overlapping expandable liners to case the wellbore. The present disclosure is susceptible to embodiments of different forms. There are shown in the drawings, and herein will be described in detail, exemplary embodiments of the present disclosure with the understanding that the present disclosure is to be considered an exemplification of the principles of the disclosure and is not intended to limit the disclosure to that illustrated and described herein.

Aspects of the disclosure herein include casing a wellbore with relatively long (for example 300-3,000 feet) overlapping and stepwise expanded s-shaped liner sections (also referred to herein as tubulars or liner members). The liner sections may be an expandable round or folded coiled tubing or welded jointed pipes that may be expanded by conventional methods. In aspects, a lower end of a liner section may be expanded into the formation and cement or embedded chemicals may be activated by compression or heat of the expansion process to fix and seal the end section. The upper end of the liner section may be expanded into the end section of the previously installed liner section. Depending on the final strength and sealing requirements for the casing, the area between the liner sections may be filled with suitable chemicals. Also, the liner sections may be expanded into each other to provide a zero or substantially zero gap, with a relatively small compression. In aspects, the liner sections may be equipped with functional elements or devices, such as centralizers, hangers, locators, seals and sensors. The liner sections may be profiled to deliver maximum collapse strength and to improve sealing and connection strength of the design. The transition areas between overlapping liners may be reinforced by selectively filling gaps in the transition areas with high performance materials, such as fiber-reinforced epoxy, shaped liner ends, etc. Such wellbores may finally be reinforced by lining the internal diameter with a liner on the surface of the internal diameter after reaching the final depth and final fluid weight reduction. In aspects, the concepts, designs and processes disclosed herein may eliminate threaded connections of jointed tubulars. Additionally, mechanical reinforcement can secure unstable formations shortly or promptly after drilling a wellbore section and can provide a larger internal diameter for drilling and completion tools prior to lowering the mud weight and setting the final production liner with mechanical reinforcement.

FIG. 1A shows a sectional view of a wellbore segment 101 of a monobore wellbore system 100 cased according to one embodiment of the disclosure. The wellbore system 100 is shown to include a wellbore 104 drilled into a formation 102. In one aspect, the wellbore 104, having a diameter "D" is drilled to a certain depth wd1. An expandable liner 110, having an outer diameter, smaller than the previous liner inner diameter, if any, is conveyed into the wellbore 102 and expanded to a desired internal diameter d1. In aspects, the liner 110 may be expanded to provide a desired annulus 103 between the liner 110 and the wellbore wall 112. The wellbore 104 is then drilled to a second depth $wd_2$ and an expandable liner 120 is deployed inside the liner 110 to depth wd2. An upper section 122 of the liner 120 is then expanded to internal diameter d2 to press against the liner 110 up to its lower end $wd_1$. The lower section 124 of liner 120 is then expanded so that the inner diameter of the lower section 124 is same as the inner diameter d1 of liner 110. The wellbore 104 is then drilled to a next depth $wd_3$ (not shown). An expandable liner 130 having an outer diameter smaller than the inner diameter d2 of liner 120 is then conveyed into the wellbore 104. The upper section 132 of the liner 130 is then expanded to press against the lower section 124 of the liner 120, while the lower section 134 of the liner 130 is expanded to an internal diameter $d_2$. The annulus 103 may be filled with a suitable material, such as cement or epoxy 160. This process of adding expandable liners may be continued until the desired wellbore length has been lined. This construction provides a wellbore segment lined with overlapping and stepwise expanded s-shaped liners 110,120 and 130. In one aspect, the overlaps between the members 110, 120 and 130 do not have a substantial gap along the length of the liners. In another aspect, there may exist an overlap throughout a substantial length of the wellbore as shown by substantially continuous overlap provided by liner sections 110, 120, 130 and 140. In aspects, spaces 105 at the overlap ends and spaced 106 between adjacent sections of liners 110, 120 and 130 may be lined with a sealing material to provide a seal between such spaces and liner sections once they are pressed against each other.

Still referring to FIG. 1A, the above-noted process, the upper and/or lower ends of the expanded liners 110, 120, 130 and 140 may be tapered during expansion to improve sealing and hanger functionality. Wellbores other than monobore wellbores or sections (i.e., same diameters over the entire section) may be built using the apparatus and methods described herein. In such cases, an liners with increased wall thickness may be used to maintain pressure integrity of the wellbore while drilling with reduced inner diameter d1 and/or d2. A deviation from the monobore wellbore approach will still deliver less borehole and production diameter reduction compared to commonly used telescopic techniques with larger diameter steps within the standard liner hanger packer systems sections. Assuming a constant increase of outer pressure load over depth, the lined wellbore would look like a taper. The section-by-section liner installation described herein also reduces the external pressure applied to the casing, depending upon the height of the mud and cement column behind the casing.

Figure 1B:
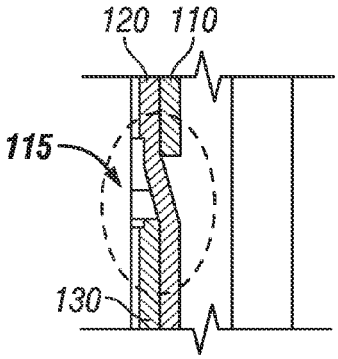
FIG. 1B is an expanded view of a transition section of overlapping liners shown in FIG. 1A.
Figure 1C:
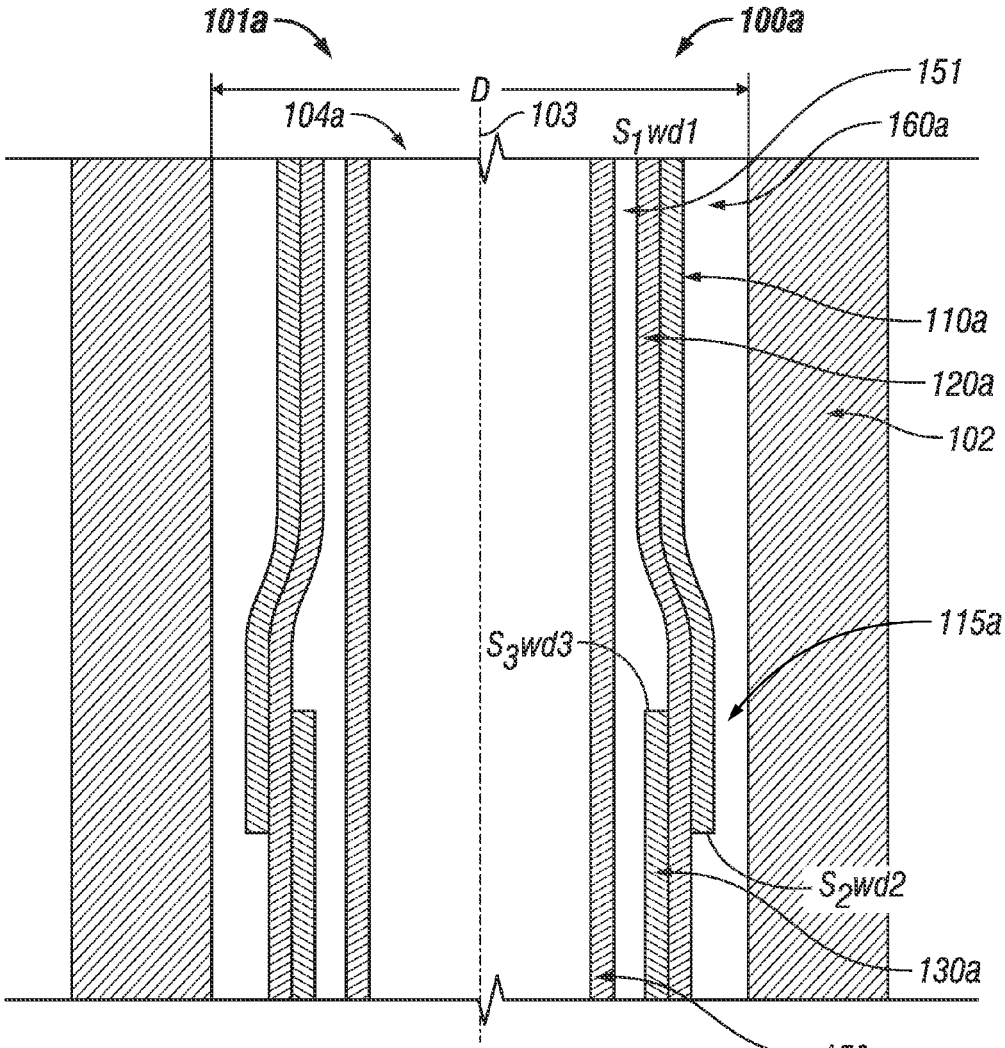
FIG. 1C shows a sectional view of a reinforced segment of a wellbore cased according to another embodiment of the disclosure.

Still referring to FIG. 1A, the liners 110, 120, 130 and 140 may be made from any suitable material having a desired thickness. In aspects, the liners 110, 120, 130 and 140 may be relatively thin so that they may be expanded relatively easily but are also strong enough to maintain the integrity of the wellbore 104 while drilling. In another aspect, an inner liner 150 may be placed along the inside of the liners 110, 120, 130, 140, etc. after completing the drilling process and before finally reducing the mud weight close to production fluid weight. The inner liner 150 may be a coiled-tubing that is expanded to compress against the inside of the liners 110, 120, 130 and 140. Pressing the liners against each other, as shown in FIG. 1, in aspects, can provide a zero gap and/or metal-to-metal seal between such liners and can provide improved sealing and increased mechanical strength during connecting, stimulation and production phases. The inner liner 150 can function as production liner made of wear-out and corrosion resistant materials, which can be replaced for maintenance FIG. 1B shows an expanded view of a transition zone (s-section) 115 of overlapping liners 110, 120 and 130 shown in FIG. 1A. The area 115 represents a potential weak point against collapse pressure, caused by the fact that the liner 120 in this section does not have an overlapping member. The collapse pressure is the pressure at which a liner deforms due to the pressure applied from the formation 102 or from fluid behind the casing. The collapse pressure also is referred to herein as "radial pressure" or the pressure applied to the liners from a direction other than the axial or longitudinal direction 111 of the liners (FIG. 1). An exemplary manner to reinforce the transition area 115 in overlapping liners system is described below in reference to FIG. 1C.

FIG. 1C shows a sectional view of a wellbore segment 101*a* of a wellbore system 100*a*, cased according to another embodiment of the disclosure. The wellbore system 100*a* shows an exemplary manner for strengthening the transition section, such as section 115 shown in FIG. 1B. In the wellbore configuration of FIG. 1C, at least two liners overlap throughout a selected portion or all of the wellbore 104*a*. In the system 100*a*, the first liner 110*a* and the second liner 120*a* overlap for the wellbore segment between depth wd1 and wd2, while a third liner 130*a* overlaps the liners 110*a* and 120*a* between depths wd3 and wd2. The third liner also continues to overlap liner 120*a* beyond the depth wd2 to a selected depth. In this manner at the potentially weak sections, such as section 115*a*, three liners 110*a*, 120*a* and 130*a* overlap, while there are at least two liners along the remaining length of the lined wellbore 104*a*. An inner liner or production tubing 150*a* is shown placed inside the liner 130*a*. An alternative method to improve the strength of the transition zone 115*a* is the selective usage of expandable high strength material in the area 115*a*. Also, any of the reinforcement methods described in reference to FIG. 1C. may be utilized to strengthen the transition zone 115*a*. Selective filling of the volume or spaces 151 between expanded liners 110*a*, 120*a* and 130*a* and production tubing 150*a* with materials, such as high strength thermal insulation cement 160*a* can increase the final pressure resistance, reduce thermal energy losses and thermal load related stresses during production and stimulation activities. Such methods may be utilized for forming monobore, telescopic and tapered wellbore.

Figure 2A:
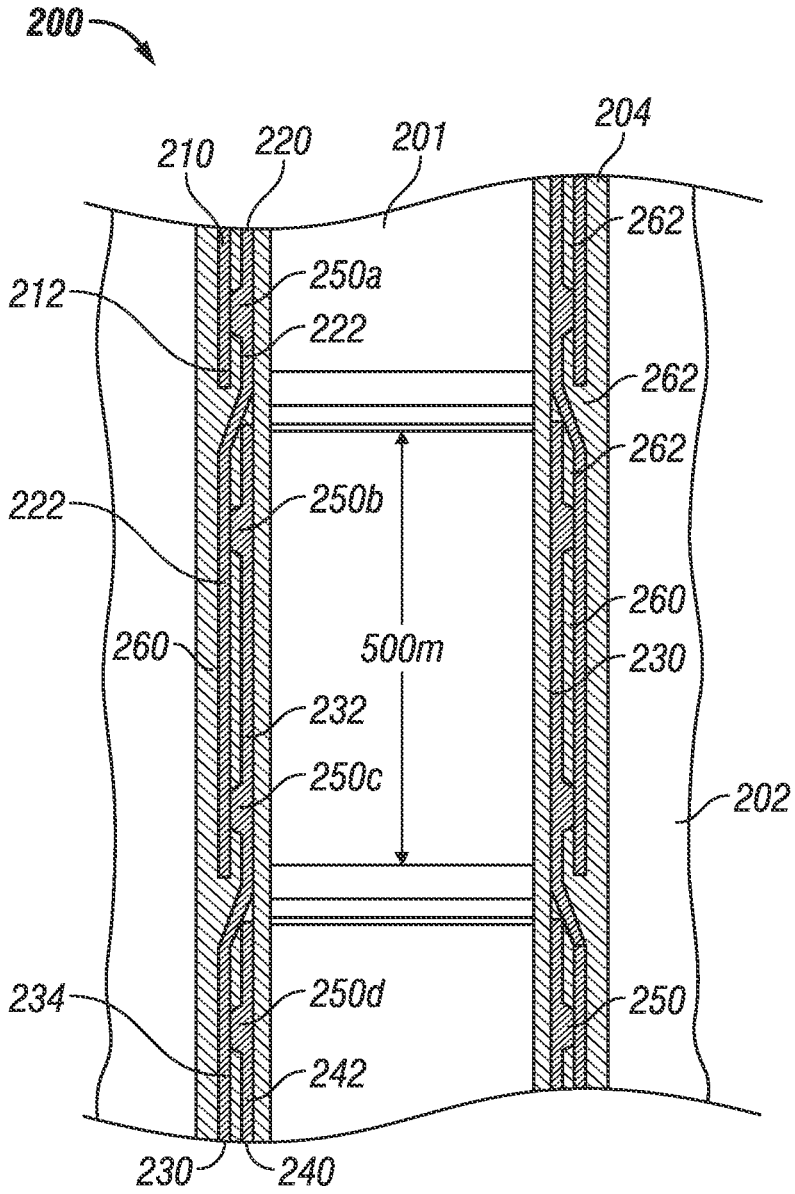
FIG. 2A shows a sectional view of a segment of a monobore wellbore cased according to another embodiment of the disclosure.

FIG. 2 shows a sectional view of a wellbore segment 201 of a monobore wellbore system 200 cased according to another aspect of the disclosure. The wellbore system 200 is shown to include a wellbore 204 drilled into a formation 202. The method of constructing or lining the wellbore system 200 is the same as described in reference to the wellbore system 100 of FIG. 1, except that the liners used herein include certain different features. In the embodiment shown in FIG. 2, the overlapping liners 210, 220, 230 and 240 include additional elements 250 that act as centralizers or circumferential seals.

The elements 250 centralize the overlapping liner sections and provide seals between such overlapping liner sections. For example, in the configuration of FIG. 2, element 250*a* centralizes lower section 212 of liner 210 and the upper section 222 of liner 220; elements 250*b* and 250*c* centralize the lower section 224 of liner 220 and the upper section 232 of liner 230; and element 250*d* centralizes the lower section 234 of liner 230 and the upper section 242 of liner 240. In one aspect, after setting each of the liners 210, 220 and 230, the annulus 260 between such liners and the wellbore 204 may be filed with a suitable material, such as cement. Liners 210, 220, 230, 240, etc. may also be lined or coated (inside and/or outside) with a suitable material 262, such as cement or fiber-filled epoxy to provide seal and additional strengthening material between the overlapping portions of such liners. Also, increased collapse strength can be achieved by increasing the bending stiffness of the liners. Thus, in aspects, the configuration shown in FIG. 2 provides liner system that includes multi-layered liner sections with filled gaps and a selected distance between the overlapping liner sections depending on the desired strength.

Figure 2B:
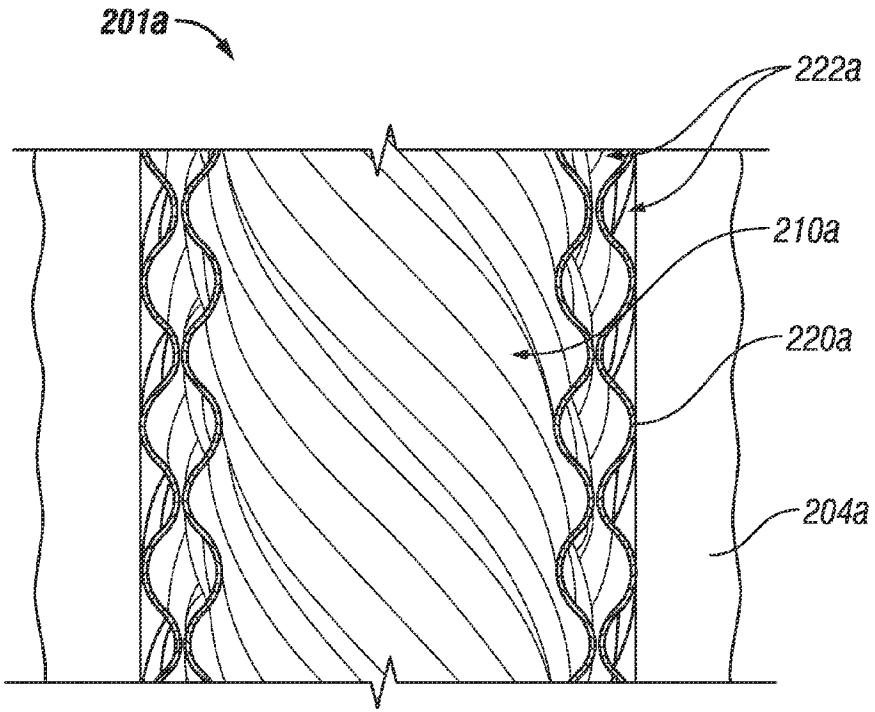
FIG. 2B shows an alternative construction of the liners for use in lining a wellbore.

FIG. 2B shows an alternative construction of expandable liners shown in FIG. 1. FIG. shows a wellbore 201*a* wherein a first 210*a* is shown expanded against the wellbore 204*a* and a second expandable liner 220*a* expanded against the first liner 210*a*. In this particular configuration, each of the liners is undulated and, when placed adjacent to each other, provide an undulated gap 220 between the liners. In one aspect, the undulated gap 222*a* may be filled with a sealing material, such as cement or epoxy to provide axial and lateral strength to the overlapping liners 210*a* and 220*a*. In an aspect, one such liner may be undulated, while the other may have a different shape, such as shown in FIG. 1.

Figure 3:
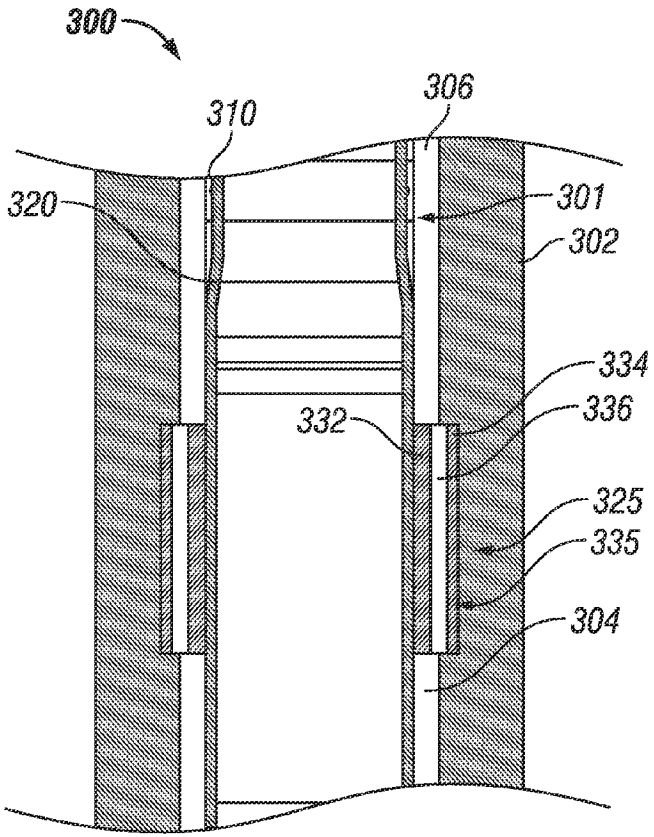
FIG. 3 shows a segment of a monobore wellbore cased according to yet another embodiment of the disclosure.

FIG. 3 shows a segment 301 of a wellbore system 300 cased according to yet another embodiment of the disclosure. The wellbore 304 includes a reinforcement net or reinforced chemical hose 306. An s-liner section 320 is shown expanded into a previously installed liner 310. The net 306 is activated or expanded and tacked in the formation 302. A reinforcement 335 may be provided to a selected wellbore section 325. The reinforcement 335 may be provided along a weak section, such as section 115 shown in FIG. 1A, to an unconsolidated rock section (such as section 402*a*, FIG. 4) and/or a formation section prone to fast creeping salt (such as section 402*b*, FIG. 4), etc. In one aspect, the reinforcement 335 may be placed during or between installation of the composite net or rubber chemical hose 306 to protect the expanded liners against collapse pressure. In one aspect, the reinforcement 335 may include a pair of expandable/foldable tubulars 332 and 334 with a sealing/filling material 336 between such tubulars. Other reinforcement structures may include members made from composite material, such a carbon fiber, combination of metallic and non-metallic materials and other suitable alloys. The sealing material may be any suitable material, including cement and epoxy.

Figure 4:
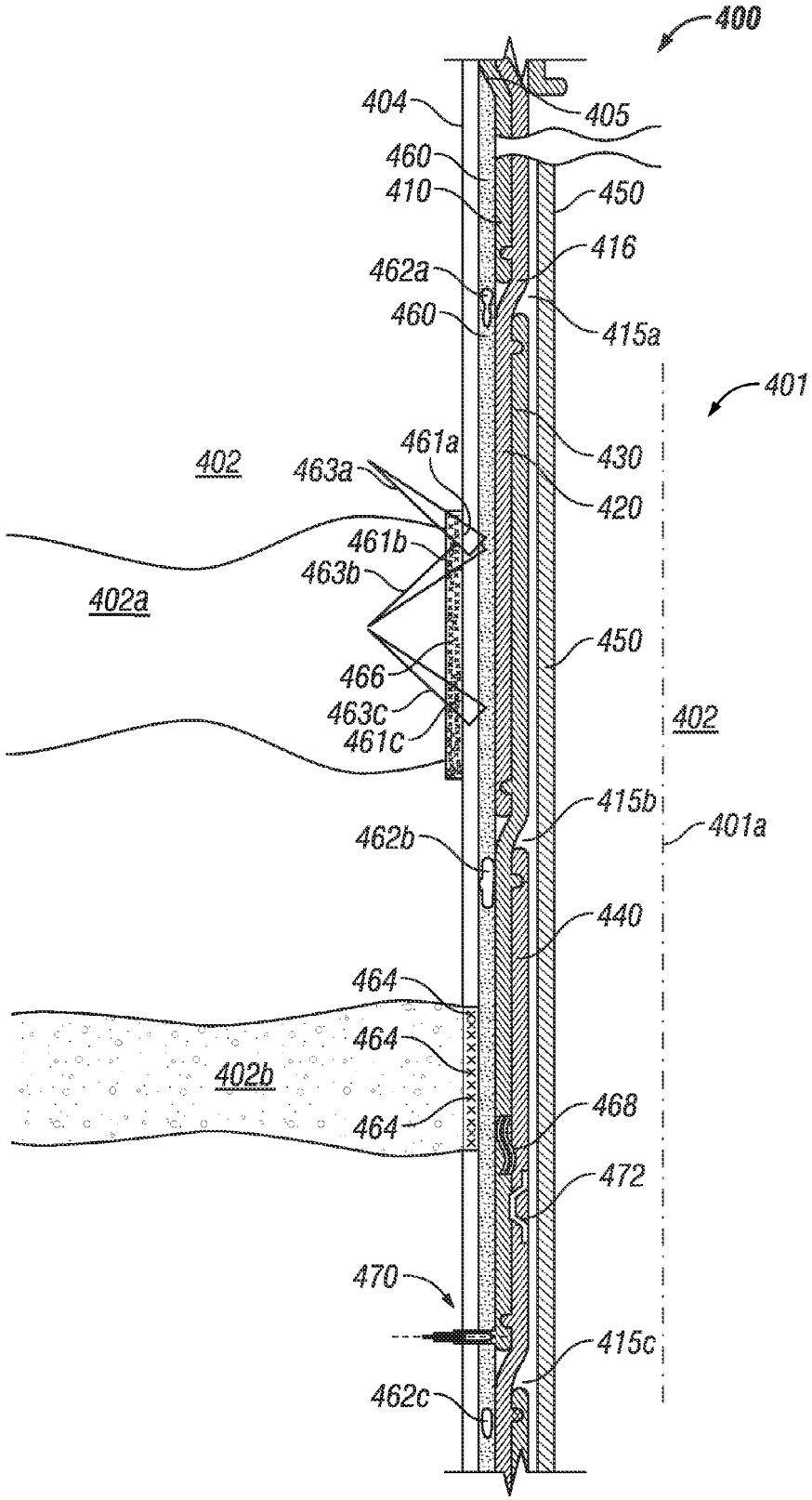
FIG. 4 shows a sectional view of a segment of a wellbore cased according to yet another embodiment of the disclosure.

FIG. 4 shows a sectional view of a wellbore section 401 of a wellbore system 400 having a central axis 401*a* cased according to yet another embodiment of the disclosure. The wellbore section 401 is shown to include a wellbore 404 in the formation 402. The wellbore 404 includes an upper section 405 that is cased and cemented. A composite net or a rubber hose 460 is shown placed against the inside of the wellbore 404. Liners 410, 420, 430 and 440 are placed in the wellbore 404 against the composite net or rubber hose 460 in the same manner as described above with respect to liners 110, 120, 130 and 140 in reference to FIG. 1. The cross-over sections (s-shaped sections with metallic seals) are shown at locations 415*a*, 415*b* and 415*c*. These cross-over sections, in one configuration, are may be made of high strength and corrosive resistant materials and placed along the liners 410, 420, 430 and 440. Alternatively, the liners may be placed so as that at least two liners overlap at the transition zones 415*a*, 415*b* and 415*c*, as described in reference to FIG. 1C. Liners are susceptible to movement after placement due to thermal expansion and other factors. To compensate for such movement, a high performance material of a flexible shape 416 may be placed at or proximate the transition zones 415*a*, 415*b* and 415*c* to provide reinforcement and axial length compensation capability. The wellbore 404 also is shown lined with a final tubular 450. Hollow compressible bodies or bubbles of compressible fluids 462*a*, 462*b* and 462*c* provide spaces within the composite net/hose 460 allow encapsulated fluids and solids in the net/hose to move, such as for example during expansion of the liners or due to thermal expansion of the fluids. Spacers 472 may be selectively placed between the liners. In addition, adjacent liners, such as liners 420 and 430 may be strengthened by providing corrugations or by forming waves in liners as shown by element 468. Waves or corrugations provide additional strength to the liners along the axial and radial directions. Liner-to-liner positioning improves the integrity of the transition zone and further by corrugations, such as corrugations 472. In addition, anchors 470 may be utilized to anchor the liners 310, 420, 430 and 440 to each other, to the composite net/hose 460 and/or the formation 402.

Still referring to FIG. 4, when a soft zone (such as unconsolidated rock) 402*a* is present, such soft zone may be reinforced with a suitable reinforcement 466, such as reinforcement 322 shown in FIG. 3 or any other reinforcement known in the art. The elements of the reinforcement 466 may be tacked in the formation 402 with multi-dimensional anchors, such as 461*a*, 461*b* and 461*c* to centralize and secure the reinforcement 466 to the formation 402. Measurement devices (or sensors) 463*a*, 463*b* and 463*c* may respectively be provided in the anchors 461*a*, 461*b* and 463*c* to measure formation properties and stress within the reinforcement. Such sensors may be placed at any other location in or proximate to the reinforcement 466. Power conductors to the sensors 461*a*, 461*b* and 461*c* and links for communication of the sensor measurements to the surface may be run in any suitable manner known in the art. For a loss zone, such as zone 402*b*, the composite net may be provided with an embedded reinforcement 464. Swellable member with seal, such as a reinforced rubber hose or composite net may be provided to secure and stabilize the loss zone 402*b*. The reinforcement 464 may include chemicals that are activated downhole to secure and stabilize the loss zone. The composite net or hose 464, along with the embedded reinforcement, provide alternatives to commonly used cement. Devices or sensors 465*a*, 465*b* may be provided to determine one or more parameters relating to the reinforcement 464 and/or the formation 402*b*.

Figure 5A:
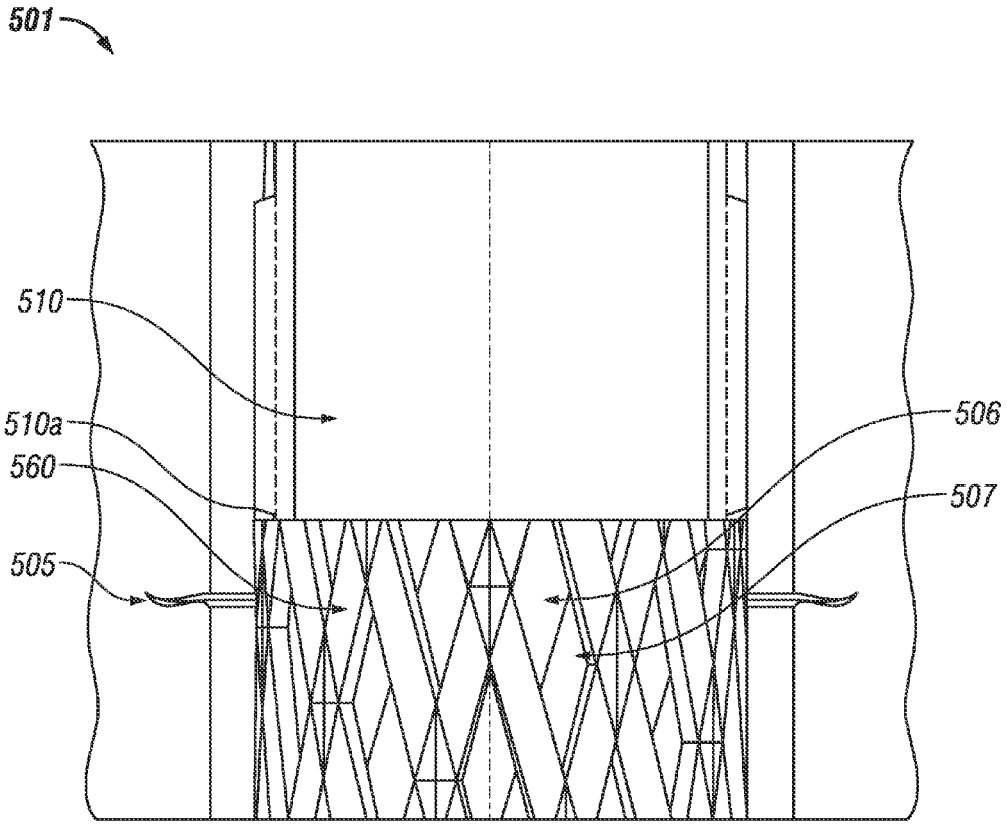
FIGS. 5A and 5B show a method of installing an expandable liner along with a composite net or hose in a wellbore, according to one method of the disclosure.
Figure 5B:
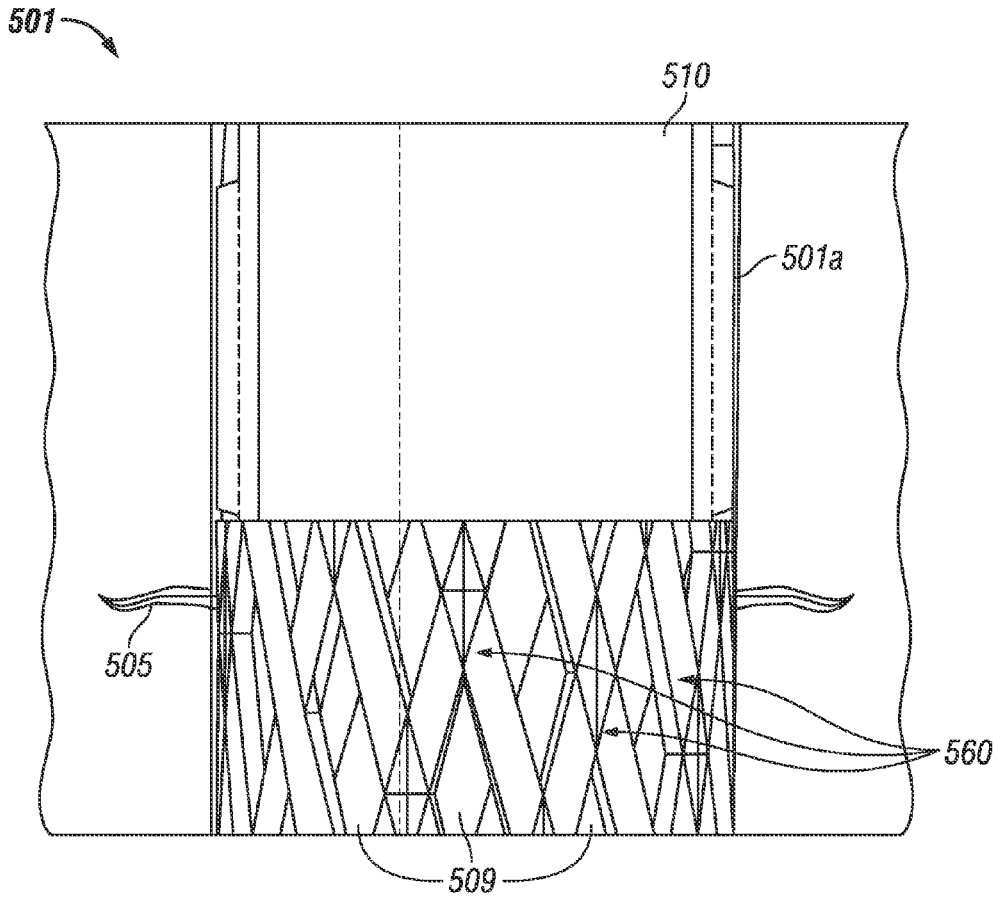

FIGS. 5A and 5B show an exemplary method of placement and expansion of a composite net 560 in a wellbore 501. The composite net 560 is placed in a first liner 510, wherein the composite net extends beyond the bottom end 510*a* of the liner 510. This combination is placed in the wellbore 501 at a desired depth. The composite net may be made from a fiber material or steel mesh or another suitable material that can be expanded downhole. The composite net is also shown to include a pair of separated chemicals 506 and 507. These chemicals, when combined with each other, form a seal around the composite net 560. After placing the liner 510 along with the composite net 560, the liner 510 and the composite net 560 inside the liner are expanded against the wellbore wall 501*a*. The composite net 560 below the liner end 510*a* is then expanded against the wellbore wall 501*a*, as shown in FIG. 5B. The chemicals are then combined to form a seal around the composite net 560. A rubber chemical hose or another reinforcing member may be used in place of the composite net 560. Expansion of the composite net or the rubber chemical hose also seals any cracks in the formation, such as crack 505.

The concepts described herein for casing while drilling is described by way of an example. The specific dimensions used herein are for purposes of ease of explanation and understanding and are not to be considered as limitations. The following steps may be utilized for construction of such a monobore wellbore:

1. Drill at a previously drilled section with an increased formation ID (e.g. 12¼") or start and end within a recess of an open borehole (e.g. a 10" recess for an 8½" open hole section). The transitions may be tapered in one or two directions to carry or transmit loads and/or to overtake sealing functions. This area allows for a sealing arrangement and for placement of other desired functional components/assemblies (e.g. pumps, condition monitoring equipment, valves, etc.)
2. Drill a first section of reduced borehole section (e.g. 8½") for installation of initial hanger and packer.
3. Install (slide and/or expand) a reinforced chemical hose (RCH) with 2 component chemicals into the ID of the wellbore.
4. Set an initial hanger, such as a 7" diameter. Set the outer OD section in the last section of the previous section (e.g. 12¼") and ID section in the first monobore section with already installed (RCH).
5. Expand the lower section (upper section axial movable to compensate for thermal effects and if desired, may be fixed with expansion process as well to improve sealing load resistance).
6. Partially expand upper section of the first 7" casing liner into the end of the hanger section. Maintain remaining gap for filling material (e.g. cement, epoxy) and drilling fluid backflow.
7. Expand lower section into RCH and activate RCH.
8. Expand upper section and activate bounded chemicals between upper and lower liner element section.
9. Drill and ream next borehole section.
10. Install (slide and/or expand) a reinforced chemical hose (RCH) with two component chemicals into the ID of the wellbore and install reinforcements if desired.
11. Run S-Liner and expand lower end in to RCH and RCH into formation and expand upper end into the lower end of the initial liner. Repeat steps 9 to 11.
12. Perforate lower section and set screen if desired.
13. Install production liner bottom up with or without expansion and/or cementation.
14. Repeat step 13 depending on the final strength of the wellbore construction. Final ID layer or first layer 140 (FIG. 1, FIG. 2 and FIG. 3) may be made of corrosion resistant material, e.g. titanium or an elastomeric material which may be retrievable and/or exchangeable over an extended time period, such as the life of the wellbore.

The selective application of a filling material between an expanded liner and the final production liner (such as liner 150, FIG. 1A, improves the final inner and outer pressure resistance, reduces the effect of galvanic corrosion and improves thermal insulation.

Thus, in aspects, the disclosure provides apparatus and methods for construction of monobore wellbore that, in one aspect, does not utilize threaded connection. Long liner sections (e.g. 300-3000 ft) may be installed, which may be reelable or foldable. Loss zone insulation while drilling may be achieved with reinforced chemical hose. The system allows on demand liner setting and may provide underbalanced drilling support. The system and methods may reduce formation and casing damage. The system utilizes low expansion force and thus may allow fast expansion process. Different materials, shapes and wall thicknesses of liner sections and the use of outer overlapping sections allows for length compensation in the middle/transition section. Additionally, improved sealing over long length of outer diameter and in overlapping section may be achieved.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A method of forming a wellbore, comprising:

placing a first liner in the wellbore, the first liner having a lower section having a first internal diameter;

placing a second liner, having an upper section having a second internal diameter less than the first internal diameter and a lower section having the first diameter, in the wellbore with the upper section of the second liner placed adjacent the lower section of the first liner; and placing a third liner, having an upper section having the second diameter, in the wellbore, with an upper section of the third liner placed adjacent a lower section of the second line;

wherein the second liner includes a transition zone between its upper section and its lower section and a portion of the upper section of the third liner and a portion of the lower section of the first liner are located in the transition zone.

2. The method of claim 1 wherein:

placing the second liner in the wellbore comprises pressing the upper section of the second liner against the lower section of the first liner; and placing the third liner in the wellbore comprises pressing the upper section of the third liner against the lower section of the second liner.

3. The method of claim 1 further comprising placing a sealing material at least one of between the first liner and the second liner and between the second liner and the third liner.

4. The method of claim 1 further comprising providing a spacer member between at least one of: the first liner and the second liner; and the second liner and the third liner.

5. The method of claim 4, wherein the spacer member is configured to act as at least one of: a centralizer; and a circumferential seal.

6. The method of claim 5 further comprising placing reinforcement in the transition area between at least two of the liners.

7. The method of claim 1 further comprising placing a sealing member along the wellbore before placing the first, second and third liners.

8. The method of claim 1 further comprising reinforcing the wellbore along a formation section that is one of: a soft formation; and a loss zone.

9. The method of claim 1, wherein at any axial location along the second liner, the second liner is overlapped by at least one of the first liner and the third liner.

10. A wellbore, comprising:

a first liner in the wellbore, the first liner having a lower section having a first internal diameter;

a second liner in the wellbore, the second liner having an upper section having a second internal diameter less than the first internal diameter and a lower section having the first diameter, wherein an upper section of the second liner is placed adjacent the lower section of the first liner; and a third liner in the wellbore, the third liner having an upper section having the second internal diameter, wherein an upper section of the third liner is placed adjacent a lower section of the second liner;

wherein the second liner includes a transition zone between its upper section and its lower section and a portion of the upper section of the third liner and a portion of the lower section of the first liner are located in the transition zone.

11. The wellbore claim 10, wherein:

the upper section of the second liner is pressed against the lower section of the first liner; and the upper section of the third liner is pressed against the lower section of the second liner.

12. The wellbore of claim 10, wherein the transition zone of the second liner forms an s-shaped transition zone.

13. The wellbore of claim 12 further comprising a reinforcement member adjacent the wellbore that is selected from a group consisting of: a composite net; and a swellable seal member.

14. The wellbore of claim 10 further comprising a sealing/strengthening material between at least one of: the first liner and the second liner; and the second liner and the third liner.

15. The wellbore of claim 10 further comprising a spacer member between at least one of: the first liner and the second liner; and the second liner and the third liner, wherein the spacer member is configured to act as at least one of: a centralizer; and a circumferential seal.

16. The wellbore of claim 10 further comprising reinforcement along a section that is one of: a soft formation; and a loss zone.

17. The wellbore of claim 10, wherein at any axial location along the second liner, the second liner is overlapped by at least one of the first liner and the third liner.

18. The wellbore of claim 17, wherein the overlaps between the first liner and the second liner and between the second liner and the third liner are 100 feet or more.

19. A wellbore, comprising:

a reinforcement member attached along inside of the wellbore; and at least three overlapping expandable liners inside the reinforcement member, the at least three overlapping expandable liners including a first liner having a lower section having a first internal diameter; a second liner having an upper section having a second internal diameter less than the first internal diameter and a lower section having the first diameter, wherein an upper section of the second liner is placed adjacent the lower section of the first liner; and a third liner having an upper section having the second internal diameter, wherein an upper section of the third liner is placed adjacent a lower section of the second liner;

wherein the second liner includes a transition zone between its upper section and its lower section and a portion of the upper section of the third liner and a portion of the lower section of the first liner are located in the transition zone of the second liner.

20. The wellbore 19, wherein the at least three overlapping expandable liners are stub welded at wellsite or are in a coiled tubing form.

21. The wellbore of claim 19, wherein the reinforcement member further comprises a compressible body configured to provide a space within the reinforcement member to allow an encapsulated fluid or solid in the reinforcement member to move.

* * * * *